United States Patent [19]

Olsen et al.

[11] 4,349,390

[45] Sep. 14, 1982

[54] METHOD FOR THE ELECTROLYTICAL METAL COATING OF MAGNESIUM ARTICLES

[75] Inventors: Asbjørn L. Olsen, Porsgrunn; Sigbjørn T. Halvorsen, Skien, both of Norway

[73] Assignee: Norsk Hydro a.s., Oslo, Norway

[21] Appl. No.: 208,482

[22] Filed: Nov. 19, 1980

[30] Foreign Application Priority Data

Dec. 7, 1979 [NO] Norway ..... 793986

[51] Int. Cl.[3] ..... C23C 3/00; C23F 7/16; C23C 3/02

[52] U.S. Cl. ..... 148/6.15 R; 148/6.27; 204/38 B; 427/304; 427/328; 427/406; 427/436; 427/437

[58] Field of Search ..... 148/6.27, 6.14 A, 6.15 R; 427/406, 436, 328, 304; 204/38 B

[56] References Cited

U.S. PATENT DOCUMENTS

| | | | |
|---|---|---|---|
| 2,060,365 | 11/1936 | Curtin | 148/6.14 A |
| 2,066,842 | 11/1936 | Lodeesen | 148/6.27 |
| 2,288,995 | 7/1942 | DeLong | 148/6.2 |
| 2,526,544 | 10/1950 | DeLong | 427/437 |

OTHER PUBLICATIONS

Modern Electroplating, "Electroplating and Electroless Plating on Magnesium and Magnesium Alloys", pp. 601-604, ©1974, edited by Lowenheim.

*Primary Examiner*—John D. Smith

*Attorney, Agent, or Firm*—Wenderoth, Lind & Ponack

[57] ABSTRACT

Improved method of producing adherent metallic coatings on articles made from magnesium is disclosed. The articles are exposed to a two-step surface activating prior to chemical precipitation of zinc deposit. The first activating is carried out in a solution of oxalic acid and after rinsing a secondary activating takes place in a special bath comprising alkali metal pyrophosphate and, preferably, an added wetting agent. The pyrophosphate is preferably potassium pyrophosphate $K_4P_2O_7$.

8 Claims, No Drawings

METHOD FOR THE ELECTROLYTICAL METAL COATING OF MAGNESIUM ARTICLES

The present invention relates to a method of producing adherent metallic coatings on articles of magnesium and magnesium-base alloys. The invention concerns more particularly an improvement of the known chemical pretreatment process where magnesium articles are coated with metallic zinc and the zinc coating is carried out by chemical reduction, so called contact coating, in a bath containing essentially zinc ions in a complex bonded state with alkali metal pyrophosphate. This method is described in U.S. Pat. No. 2,526,544 and comprises the following main steps:

1. Surface preparation by mechanical pretreatment-machining, polishing, buffing, tumbling, brushing. Degreasing by organic solvents or alkaline cleaning baths followed by pickling in phosphoric acid or in other known pickling solutions for magnesium.
2. Activating the surface in phosphoric acid and ammonium bifluoride (U.S. Pat. No. 2,288,995).
3. Chemical zinc coating at 80°–85° C. in a bath consisting of zinc sulphate, alkali metal pyrophosphate and alkali fluoride.
4. Electrolytic copper strike in a cyanide bath.
5. Standard electrolytic metal coating.

The pretreatment prior to the zinc coating in item 3 is of crucial importance for the quality of the coating itself in terms of adhesion, corrosion resistance and decorative effect of subsequent plated metallic coatings. On this zinc layer any suitable metal can be deposited by electroplating in alkaline baths. Consequently the surface has to be free from oxide and dirt, oil and other contamination. Prior to the deposition of zinc, a thorough cleaning, degreasing and pickling or activating of the metal surface must be carried out.

The known pickling/activating methods have proved to work well on homogenous materials such as sheets and extrusions, but on castings, and especially pressure die castings, it is difficult to achieve a satisfactory coating quality. It is assumed that the activating baths applied in the aforementioned patented process, after pickling in a solution of phosphoric acid or other pickling solutions, develop an etched microstructure followed by the formation of $MgF_2$ film on or around the intermetallic phases. This results in a chemical/electrochemical surface structure which has an adverse effect on the subsequent contact zinc coating so that the precipitation of zinc runs unevenly or zone wise. It is therefore necessary to increase the treatment time and/or bath temperature in order to achieve a sufficiently dense zinc deposit over the entire surface. This however involves a local "overzincating", resulting in a porous zinc deposit with a poor mechanical strength which in turn gives poor retention/adhesion of the subsequent metallic coatings. Long treatment time also means higher consumption of chemicals and reduced bath life.

It has been experienced in practice that it is possible to achieve better results by omitting the above mentioned pickling and activating steps in the process. This however requires very efficient mechanical cleaning of the metal surface prior to degreasing and chemical zinc precipitation. In spite of the fact that this modified method has to a certain extent been useful in practice it is not, however, entirely satisfactory. It has been necessary to carry out a very thorough mechanical pretreatment which is more difficult and costly where pressure die cast articles are concerned. Such articles are often of complex design with narrow recesses which are difficult to reach with mechanical treatment.

It has now been surprisingly found that adherent metallic coatings can be deposited on substrata of magnesium and magnesium-base alloys without encountering the above mentioned difficulties, by applying a certain pretreatment to the substrate.

It is therefore an object of the present invention to provide a method of producing adherent metallic coatings of high quality on articles made from magnesium and magnesium-base alloys.

In general the invention consists in providing an adherent metallic coating on the surface of magnesium-base or magnesium alloy articles and comprises, after mechanical treatment and if necessary cleaning in organic solvents, a two-step activating where the articles are first treated in a solution of oxalic acid, and then rinsed in water and transferred to subsequent activating in a pyrophosphate bath followed by chemical zinc coating in a manner known per se.

Other characteristics and special features of the invention will be apparent from the following description and examples.

In the first step of the activating of magnesium articles, i.e. pickling in an aqueous solution of oxalic acid, oxides and non-metallic inclusions are dissolved and transformed. Reaction products, which are formed on the article surface in this step, are easily removed by merely rinsing in water, contrary to currently known pickling processes where other organic or inorganic acids are applied. It has been shown that the reactivity increases in the subsequent treatment in the pyrophosphate bath.

The second activating step consists in activating-/deoxidation in an aqueous solution of an alkali metal pyrophosphate, e.g. potassium or sodium pyrophosphate, to which an alkali metal carbonate ($Na_2CO_3$ or $K_2CO_3$) is preferably added in order to achieve the desired pH in the bath. The amount of the alkali metal pyrophosphate is from 10 to 200 g/l, preferably from 50 to 75 g/l. The activating is based upon the ability of the pyrophosphate to dissolve and bind metal oxides and hydroxides by the formation of a complex mainly according to the following reaction:

$$2Mg(OH)_2 + xP_2O_7^4 \rightarrow [Mg_2(P_2O_7)x]^{-2x}$$

The formation of magnesium hydroxide proceeds continuously on the metal surface according to the following reaction:

$$Mg + 2H_2O \rightarrow Mg(OH)_2 + H_2 \uparrow$$

Both these reactions will also take place during direct chemical zinc coating without previous activating because of the excess of pyrophosphate in the bath. However, such direct zinc coating has the disadvantage of producing an uneven zinc coating. The most active areas are coated first, while it takes a longer time to cover the less active areas with zinc. This is a considerable disadvantage since the treatment time should not exceed 3 minutes with regard to the coating quality and the life of the bath. Besides, the precipitation process will be upset by the generated hydrogen.

Activating in accordance with the principles of this invention has the advantage of achieving uniform zinc precipitation over the entire metal surface. This is of fundamental importance both with respect to the coating quality and the possibilities for process control. Furthermore the precipitation proceeds with negligible or no gas generation. Pyrophosphate activating also has the effect of increasing the reaction rate in the zinc coating process. This is favourable for the process and makes it possible to reduce treatment time and lower bath temperature which is an advantage as concerns the environment and energy consumption, and results in increased bath life and a lower consumption of chemicals.

DESCRIPTION OF THE METHOD

The treatment process comprises basically the following steps:

1. Mechanical pretreatment,
2. Degreasing in organic solvents, e.g. trichlorethylene, perchlorethylene or trichlorethane if necessary.
3. Pretreatment/activating. 3.1. Pickling/activating in oxalic acid, 3.2. Activating by means of alkali metal pyrophosphate,
4. Chemical zinc precipitation,
5. Electrolytic metal coating (Zn, Sn, Cu, Ni, Cr etc.), Steps 1, 2, 4 and 5 are well known, conventional treatment steps which do not need further explanation.

The preferred solutions and conditions for the treatment of magnesium articles in step no.3 are as follows:

Step 3.1.—bath composition

| | |
|---|---|
| Oxalic acid ($C_2H_2O_4.2\ H_2O$) | 2–10 g/l |
| Wetting agent (Fluortensid FT 248) | 0.5 g/l |
| Balance water | |
| Bath temperature | 10–40° C. |
| Treatment time | 5–120 sec |

After rinsing in water the articles are transferred to step two of the activating process in the deoxidation bath.

Step 3.2.—bath composition

| | |
|---|---|
| Potassium or sodium pyrophosphate ($K_4P_2O_7$ or $Na_4P_2O_7$) | 10–200 g/l |
| Sodium carbonate ($Na_2CO_3$) for pH-adjustment | up to 50 g/l |
| Wetting agent (FT 248) | 0.5 g/l |
| Balance water | |
| pH | 10.0–11.5 |
| Bath temperature | 20–80° C. preferably 55–65° C. |
| Treatment time | 0.5–3 min. |

EXAMPLES

Pressure cast articles have been pretreated in accordance with the present invention (tests 1–6). As a reference the activating of articles has also been carried out in accordance with the patented process of U.S. Pat. No. 2,288,995 (tests 7–8).

| | |
|---|---|
| Test materials: | Pressure die cast plates 50 × 150 × 4 mm |
| Alloys: | AZ 61 (6 wt % Al, 1 wt % Zn, balance Mg + usual impurities) |
| | AZ 91 (9 wt % Al, wt % Zn, balance Mg + usual impurities) |
| Mechanical pretreatment | Vibrating |

Test 1

| | | |
|---|---|---|
| 1. | Activating in oxalic acid solution: | |
| | Oxalic acid ($C_2H_2O_4.2\ H_2O$) | 5.0 g/l |
| | Wetting agent (FT 248) | 0.5 g/l |
| | Balance water | |
| | Bath temperature | 20–25° C. |
| | Treatment time | 30 sec. |
| 2. | Water rinse | |
| 3. | Activating in pyrophosphate bath: | |
| | Potassium pyrophosphate ($K_4P_2O_7$) | 10.0 g/l |
| | Wetting agent (FT 248) | 0.5 g/l |
| | Balance Aqua pura | |
| | pH | 10.5 |
| | Bath temperature | 80° C. |
| | Treatment time | 30 sec. |
| 4. | Water rinse | |
| 5. | Chemical zincating | |
| | Bath composition: | |
| | Zinc sulphate ($ZnSO_4.7\ H_2O$) | 50 g/l |
| | Potassium pyrophosphate ($K_4P_2O_7$) | 150 g/l |
| | Potassium fluoride (KF) | 7 g/l |
| | Sodium carbonate ($Na_2CO_3$) | 5 g/l |
| | pH | 10.2–10.5 |
| | Bath temperature | 60–65° C. |
| | Treatment time | 3 min. |
| 6. | Water rinse | |
| 7. | Copper strike in alkaline/cyanic bath (Schering/Ultinal) with the following concentrations of copper and free cyanide: | |
| | Cu | 40–45 g/l |
| | Free KCN | 20–25 g/l |
| | pH | 12–13 g/l |
| | Bath temperature | 60° C. |
| | Cathode current density | 2 A/dm$^2$ |
| | Deposit thickness | 15 μm |
| 8. | Water rinse | |
| 9. | Nickel plating (Bright nickel bath, Schering "Duplalux G"): | |
| | Cathode current density | 3 A/dm$^2$ |
| | Deposit thickness | 10 μm |

Test 2

Steps 1–2 as Test 1.

| | | |
|---|---|---|
| 3. | Activating: | |
| | Potassium pyrophosphate ($K_4P_2O_7$) | 200.0 g/l |
| | Wetting agent (FT 248) | 0.5 g/l |
| | Balance Aqua pura | |
| | pH | 10.07 |
| | Bath temperature | 20–25° C. |
| | Treatment time | 30 sec. |

Steps 4–9 as Test 1.

Test 3

Steps 1–2 as Test 1.

| | | |
|---|---|---|
| 3. | Activating: | |
| | Potassium pyrophosphate ($K_4P_2O_7$) | 200.0 g/l |
| | Wetting agent (FT 248) | 0.5 g/l |
| | Balance Aqua pura | |
| | pH | 10.07 |
| | Bath temperature | 50° C. |
| | Treatment time | 30 sec. |

Steps 4–9 as Test 1.

Test 4

Steps 1–2 as Test 1.

3. Activating:

-continued

| | |
|---|---|
| Potassium pyrophosphate ($K_4P_2O_7$) | 200.0 g/l |
| Sodium carbonate ($Na_2CO_3$) | 50.0 g/l |
| Wetting agent (FT 248) | 0.5 g/l |
| Balance Aqua pura | |
| pH | 11.30 |
| Bath temperature | 50° C. |
| Treatment time | 30 sec. |

Steps 4–9 as Test 1.

Test 5

Steps 1–2 as Test 1.

| | | |
|---|---|---|
| 3. | Activating: | |
| | Potassium pyrophosphate ($K_4P_2O_7$) | 50.0 g/l |
| | Sodium carbonate ($Na_2CO_3$) | 15.0 g/l |
| | Wetting agent (FT 248) | 0.5 g/l |
| | Balance Aqua pura | |
| | pH | 11.20 |
| | Bath temperature | 60° C. |
| | Treatment time | 30 sec. |

Steps 4–9 as Test 1.

Test 6

Steps 1–2 as Test 1.

| | | |
|---|---|---|
| 3. | Activating: | |
| | Sodium pyrophosphate ($Na_4P_2O_7$) | 60.0 g/l |
| | Sodium carbonate ($Na_2CO_3$) | 15.0 g/l |
| | Wetting agent (FT 248) | 0.5 g/l |
| | Balance Aqua pura | |
| | pH | 11.10 |
| | Bath temperature | 60° C. |
| | Treatment time | 30 sec. |

Steps 4–9 as Test 1.

Test 7

Activating according to the patented process (reference 1)

| | | |
|---|---|---|
| 1. | Alkaline degreasing | 5 min. at 80° C. |
| 2. | Water rinse | |
| 3. | Pickling in phosphoric acid: | |
| | 85% $H_3PO_4$ | 900 ml/l |
| | Aqua pura | 100 ml/l |
| | Bath temperature | 20–25° C. |
| | Treatment time | 45 sec. |
| 4. | Water rinse | |
| 5. | Activating in phosphoric acid/bifluoride: | |
| | Phosphoric acid (85% $H_3PO_4$) | 200 ml/l |
| | Sodium hydrogen fluoride ($NaHF_2$) | 100 g/l |
| | Balance water | |
| | Bath temperature | 20–25° C. |
| | Treatment time | 1 min. |
| 6. | Water rinse | |

Further treatment is identical with steps 5–9 in Test 1.

Test 8

Direct activating modified according to the patented process (reference 2):

1. Alkaline degreasing as in Test 7.
2. Water rinse
3. Activating in phosphoric acid/bifluoride as in step 5 in Test 7.
4. Water rinse Further treatment identical with steps 5–9 in Test 1.

The quality of the deposit on articles from all tests has been evaluated based against the following criteria:

1. Visual appraisal of the Cu/Ni deposit immediately after precipitation.
2. Heat test at 150° C. for 1 hour followed by quenching in water at 20°–25° C. (ISO R1456 Quenching test for adhesion).

The evaluated samples were divided into four groups:

1. Deposit of good quality, no blistering, good adhesion.
2. Small blisters in the coating.
3. Blister formation and failures in the coating.
4. Extremely poor adhesion.

The results are shown in Table 1.

TABLE 1

| | The quality of Cu/Ni-coating: | | | |
|---|---|---|---|---|
| | Alloy AZ 61 | | Alloy AZ 91 | |
| Test No. | Prior to heat test | Adhesion after ISO R 1456 | Prior to heat test | Adhesion after ISO R 1456 |
| 1 | 1 | 1 | 1 | 1 |
| 2 | 1 | 1 | 1 | 1 |
| 3 | 1 | 1 | 1 | 1 |
| 4 | 1 | 1 | 1 | 1 |
| 5 | 1 | 1 | 1 | 2 |
| 6 | 1 | 1 | 1 | 1 |
| 7 (Ref. 1) | 3 | 4 | 3 | 4 |
| 8 (Ref. 2.) | 2 | 4 | 3 | 4 |

The tests show clearly that two step activating according to the invention is a better pretreatment method than any of the processes known hitherto.

The FT 248 wetting agent employed in tests 1–6 is an anion active fluorated wetting agent, more particularly a quaternary ammonium salt of a long chain perfluorated alkane sulfonic acid.

We claim:

1. A method of chemically precipitating a zinc deposit onto an article of magnesium or a magnesium-base alloy, which comprises treating the article in a solution of oxalic acid; rinsing the thus treated article; treating the rinsed article in a bath comprising from 10 to 200 g/l of alkali metal pyrophosphate and, as the balance, mainly water, to provide an activated article; rinsing the activated article; and coating the rinsed, activated article with zinc.

2. A method according to claim 1, wherein the bath contains potassium pyrophosphate in a concentration of from 50 to 75 g/l.

3. A method according to claim 1 or 2, wherein the bath contains an alkali metal carbonate as a buffer, and the pH of the bath is 10–11.5.

4. A method according to claim 3, wherein the bath has a temperature of 55°–65° C.

5. A method according to claim 1, wherein the bath further comprises a wetting agent.

6. A method according to claim 1, 2 or 5, wherein the article is, prior to treatment in the solution of oxalic acid, subjected to a mechanical and/or chemical pretreatment.

7. A method according to claim 3, wherein the article is, prior to treatment in the solution of oxalic acid, subjected to a mechanical and/or chemical pretreatment.

8. A method according to claim 4, wherein the article is, prior to treatment in the solution of oxalic acid, subjected to a mechanical and/or chemical pretreatment.

* * * * *